US010068538B2

(12) United States Patent
Tanaka et al.

(10) Patent No.: US 10,068,538 B2
(45) Date of Patent: Sep. 4, 2018

(54) DISPLAY DEVICE SPECIFYING TEMPERATURE DISTRIBUTION OF DISPLAY SURFACE

(71) Applicant: Japan Display Inc., Tokyo (JP)

(72) Inventors: Chihiro Tanaka, Tokyo (JP); Toshihiko Tanaka, Tokyo (JP); Toshinori Uehara, Tokyo (JP)

(73) Assignee: Japan Display Inc., Tokyo (JP)

( * ) Notice: Subject to any disclaimer, the term of this patent is extended or adjusted under 35 U.S.C. 154(b) by 409 days.

(21) Appl. No.: 14/795,565

(22) Filed: Jul. 9, 2015

(65) Prior Publication Data

US 2016/0012760 A1 Jan. 14, 2016

(30) Foreign Application Priority Data

Jul. 11, 2014 (JP) ..... 2014-143069

(51) Int. Cl.
*G09G 3/36* (2006.01)

(52) U.S. Cl.
CPC ... *G09G 3/3648* (2013.01); *G09G 2300/0426* (2013.01); *G09G 2320/041* (2013.01)

(58) Field of Classification Search
CPC ..... G09G 3/3648; G09G 2320/041; G09G 2300/0426; G09G 3/006
USPC ..... 345/101
See application file for complete search history.

(56) References Cited

U.S. PATENT DOCUMENTS 6,028,579 A * 2/2000 Tsuboyama ..... G09G 3/3629 345/94
6,288,707 B1 * 9/2001 Philipp ..... G06F 3/0213 341/22
7,382,139 B2 * 6/2008 Mackey ..... G06F 3/044 324/660
2005/0122305 A1 * 6/2005 Murao ..... G02F 1/133382 345/101
2006/0152454 A1 * 7/2006 Cok ..... G09G 3/3208 345/82
2007/0257894 A1 * 11/2007 Philipp ..... G06F 3/044 345/173
2008/0143656 A1 * 6/2008 Hasegawa ..... G09G 3/3233 345/84
2008/0252608 A1 * 10/2008 Geaghan ..... G06F 3/044 345/173

(Continued)

FOREIGN PATENT DOCUMENTS

JP 2011-099879 5/2011

*Primary Examiner* — William Boddie
*Assistant Examiner* — Andrew Schnirel
(74) *Attorney, Agent, or Firm* — K&L Gates LLP

(57) ABSTRACT

According to an aspect, a display device comprising: a display unit; a plurality of electrodes arranged side by side in a first direction along a display surface of the display unit; a detecting unit that detects one of an electric resistance of the electrodes, a voltage, and a current; and a specifying unit that specifies temperature distribution of the display surface based on the one of the electric resistance of the electrodes, the voltage, and the current. The electrodes are tapered in a second direction along the display surface and orthogonal to the first direction, and the electrodes include a first electrode tapered toward one side in the second direction and a second electrode tapered toward the other side opposite to the one side. The first and second electrodes are alternately arranged side by side in the first direction.

5 Claims, 14 Drawing Sheets

(56) References Cited

U.S. PATENT DOCUMENTS

| | | | | |
|---|---|---|---|---|
| 2008/0290806 | A1* | 11/2008 | Tada | G09G 3/3233 315/169.1 |
| 2009/0009107 | A1* | 1/2009 | Nomura | G09G 3/3225 315/307 |
| 2010/0123670 | A1* | 5/2010 | Philipp | G06F 3/044 345/173 |
| 2011/0062971 | A1* | 3/2011 | Badaye | G06F 3/044 324/686 |
| 2013/0108061 | A1* | 5/2013 | Ando | G06F 3/0433 381/55 |
| 2015/0205436 | A1* | 7/2015 | Iwamoto | G06F 3/0418 345/174 |
| 2015/0220175 | A1* | 8/2015 | Zhang | G06F 3/044 345/178 |

* cited by examiner

DISPLAY DEVICE SPECIFYING TEMPERATURE DISTRIBUTION OF DISPLAY SURFACE

CROSS REFERENCES TO RELATED APPLICATIONS

The present application claims priority to Japanese Priority Patent Application JP 2014-143069 filed in the Japan Patent Office on Jul. 11, 2014, the entire content of which is hereby incorporated by reference.

BACKGROUND

1. Technical Field

The present invention relates to a display device.

2. Description of the Related Art

Liquid crystal display devices typically used as display devices have response characteristics varying depending on a temperature in operation. To address this, there have been developed methods for controlling an operation of a liquid crystal display device depending on the temperature detected by a temperature sensor that detects ambient temperature of the liquid crystal display device (e.g., Japanese Patent Application Laid-open Publication No. 2011-099879 (JP-A-2011-099879)).

When the temperature of a portion in a display area of such a liquid crystal display device reaches a high temperature equal to or higher than a certain temperature, a display failure at the portion may possibly occur because of liquid crystal characteristics. When the temperature of a part or the whole of a liquid crystal display device exceeds 100 degrees C. because of exposure to sunlight, for example, a display failure may possibly occur, such as disturbance in the display contents in the heated portion and incapability of display. To address such a problem due to the temperature, it is necessary to specify the temperature distribution of a display surface of a liquid crystal display device. The method described in JP-A-2011-099879, however, cannot specify the temperature distribution of the display surface.

For the foregoing reasons, there is a need for a display device that can specify the temperature distribution of a display surface.

SUMMARY

According to an aspect, a display device includes: a display unit that displays an image; a plurality of electrodes arranged side by side in a first direction along a display surface of the display unit; a detecting unit that detects one of an electric resistance of the electrodes, a voltage, and a current, the voltage and the current corresponding to the electric resistance; and a specifying unit that specifies temperature distribution of the display surface based on the one of the electric resistance of the electrodes, the voltage, and the current. The electrodes are tapered in a second direction along the display surface and orthogonal to the first direction, and the electrodes include a first electrode tapered toward one side in the second direction and a second electrode tapered toward the other side opposite to the one side. The first and second electrodes are alternately arranged side by side in the first direction.

Additional features and advantages are described herein, and will be apparent from the following Detailed Description and the figures.

DETAILED DESCRIPTION

Figure 1:
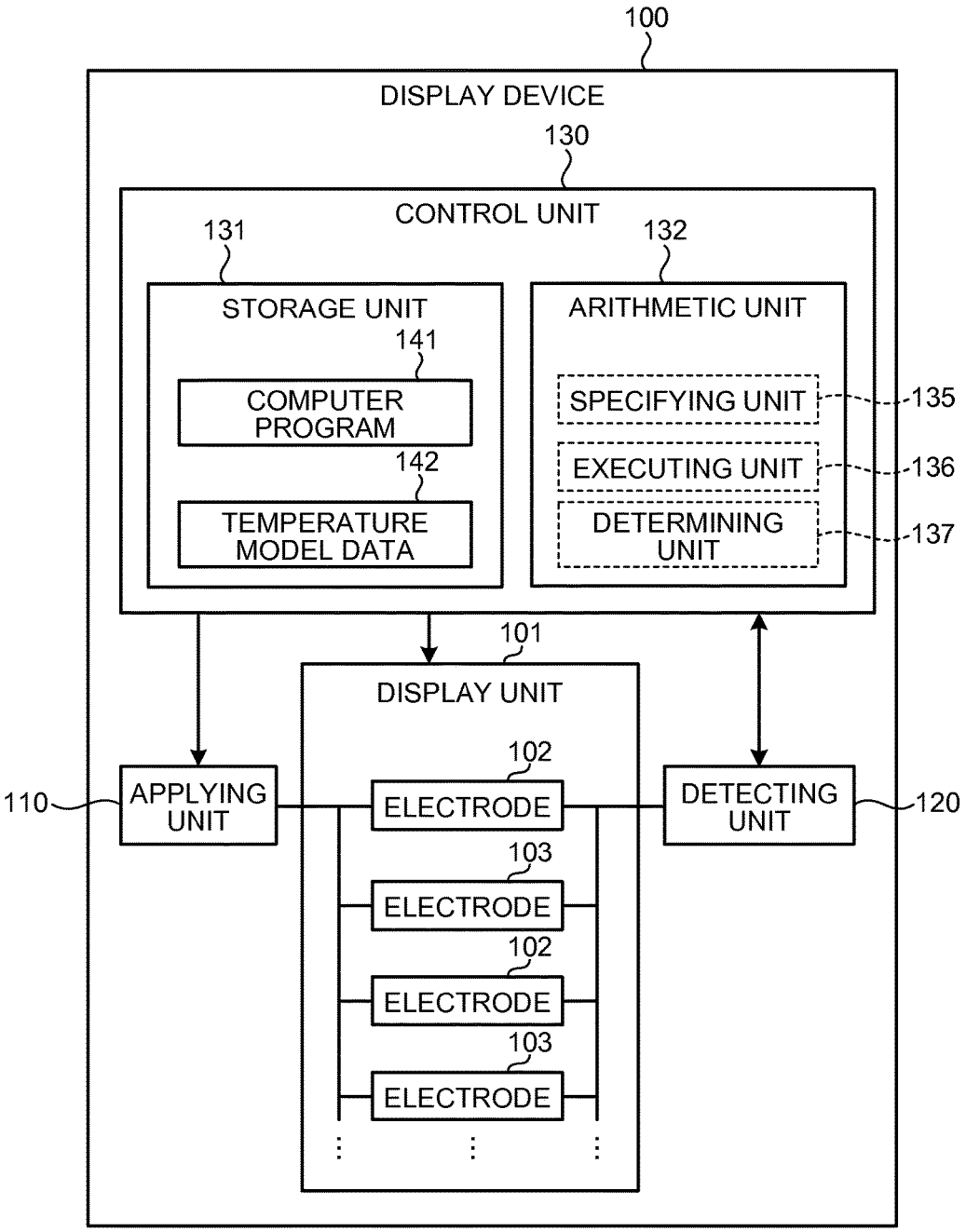
FIG. 1 is a block diagram of a configuration relating to major functions of a display device according to a first embodiment.

Exemplary embodiments according to the present invention are described below with reference to the accompanying drawings. The disclosure is given by way of example only, and modifications made without departing from the spirit of the invention and easily conceivable by those skilled in the art are obviously included in the scope of the present invention. To give a clear explanation, the drawings may illustrate the width, the thickness, the shape, and other factors of each unit more schematically than those in an actual aspect. The drawings, however, are given by way of example only and are not intended to limit the interpretation of the invention. Components in the present specification and the drawings identical to those in prior drawings are denoted by like reference numerals, and detailed explanation thereof will be omitted.

A first embodiment of the present invention will be described with reference to FIGS. 1 to 8. In the following description, a certain direction along a display surface 101*a* is denoted by an X-direction. A direction along the display surface 101*a* and orthogonal to the X-direction is denoted by a Y-direction. A direction orthogonal to the X-direction and the Y-direction is denoted by a Z-direction.

FIG. 1 is a block diagram of a configuration relating to major functions of a display device 100 according to the first embodiment. As illustrated in FIG. 1, the display device 100 includes a display unit 101, a plurality of electrodes 102 and 103, an applying unit 110, a detecting unit 120, and a control unit 130.

The display device 100 is a matrix liquid crystal display device, for example. Specifically, the display device 100 includes a laminated substrate (e.g., a glass substrate) having a pixel substrate provided with pixel electrodes, a counter substrate, and liquid crystals interposed therebetween. The display unit 101 is included in the laminated substrate. The applying unit 110, the detecting unit 120, and the control unit 130 are provided as, for example, a circuit mounted on an external substrate coupled to the laminated substrate with a flexible printed circuit (FPC) interposed therebetween.

Figure 2:
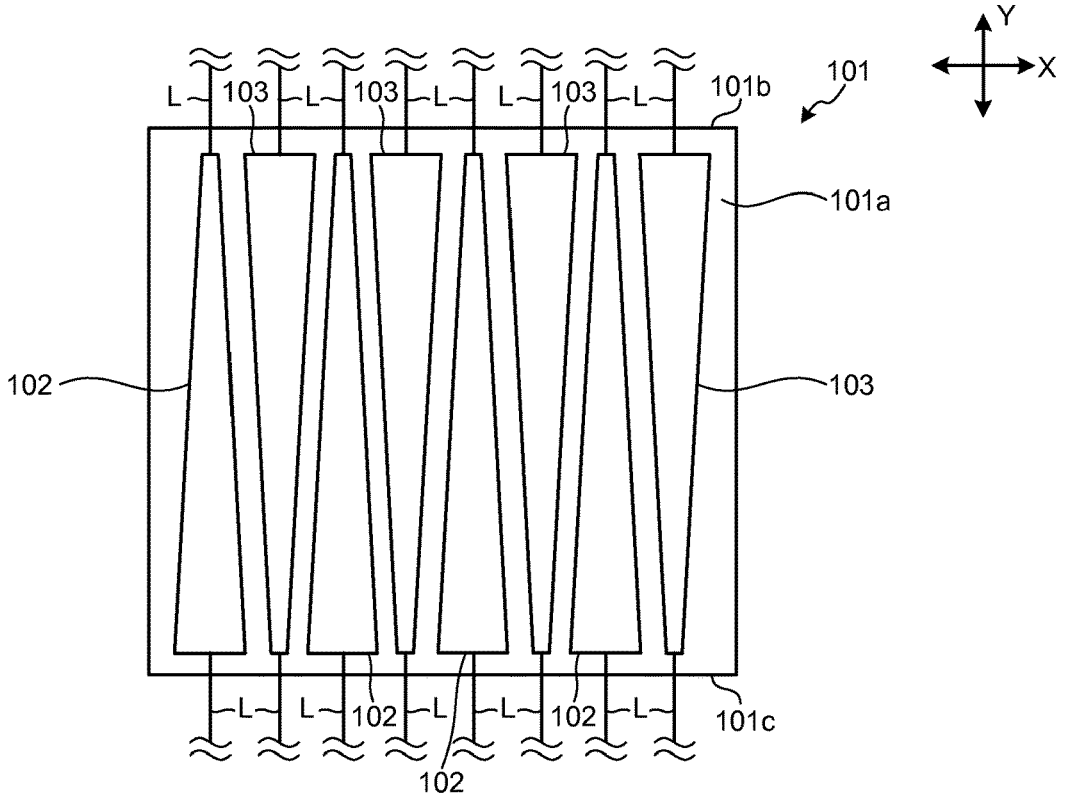
FIG. 2 is a schematic diagram of the shape of a plurality of electrodes and an arrangement example thereof.

FIG. 2 is a schematic diagram of the shape of the electrodes 102 and 103 and an arrangement example thereof. As illustrated in FIG. 2, the electrodes 102 and 103 are arranged side by side in a first direction (e.g., the X-direction) along the display surface 101*a* of the display unit 101. Specifically, the electrodes 102 and 103 are aligned in the X-direction with the longitudinal direction thereof extending along the Y-direction, for example. In the first embodiment, a plurality of electrodes 102 and a plurality of electrodes 103 are provided. The electrodes 102 and 103 are tapered in a second direction (e.g., the Y-direction) along the display surface 101*a* of the display unit 101 and orthogonal to the first direction. "Being tapered in the second direction" means "being made thinner from one end to the other end in the second direction". Specifically, the electrodes 102 and 103, for example, are thin-film electrodes the longitudinal direction of which extends in the Y-direction. As illustrated in FIG. 2, the electrodes 102 have a trapezoidal shape tapered toward a side 101*b* (the upper side in FIG. 2) of the rectangular display unit 101. The electrodes 103 have a trapezoidal shape tapered toward a side 101*c* (the lower side in FIG. 2) opposite to the side 101*b* of the rectangular display unit 101. As described above, the electrodes 102 and 103 include first electrodes and second electrodes. The first electrodes (e.g., the electrodes 102) are tapered toward one side (e.g., the upper side in FIG. 2) in the second direction (e.g., the Y-direction), whereas the second electrodes (e.g., the electrodes 103) are tapered toward the other side (e.g., the lower side in FIG. 2) opposite to the one side. As illustrated in FIG. 2, the electrodes 102 and the electrodes 103 are alternately arranged in the X-direction. In other words, the first electrodes (e.g., the electrodes 102) and the second electrodes (e.g., the electrodes 103) are alternately aligned in the first direction (e.g., the X-direction).

The electrodes 102 and 103 are transparent electrodes provided in the display unit 101. Specifically, the electrodes 102 and 103 are made of a translucent conductor, such as an indium tin oxide (ITO). An ITO is given as an example of the material of the electrodes 102 and 103. The material is not limited thereto and may be appropriately changed. The electrodes 102 and 103, for example, are coupled to wiring L on both ends in the Y-direction. The wiring L couples the electrodes 102 and 103 to the applying unit 110 and the detecting unit 120.

The applying unit 110 applies electrical signals to the electrodes 102 and 103. Specifically, the applying unit 110 includes a circuit and a controller, for example. The circuit outputs predetermined pulse signals to the electrodes 102 and 103 as the electrical signals. The controller switches whether the circuit outputs or does not output the pulse signals. The applying unit 110 is electrically coupled to the electrodes 102 and 103 to output the pulse signals to the electrodes 102 and 103.

The detecting unit 120 detects an electrical change in the electrodes 102 and 103 caused by the electrical signals. Specifically, the detecting unit 120, for example, is a circuit that measures an electric resistance of the electrodes 102 and 103. The detecting unit 120 measures the electric resistance of the electrodes 102 and 103 based on the value of a current flowing through the electrodes 102 and 103 in response to the pulse signals applied by the applying unit 110 or on the value of a voltage of the electrodes 102 and 103. The applying unit 110 and the detecting unit 120, for example, are coupled to the electrodes 102 and 103 via a switch that switches between the electrodes 102 and 103 to which the applying unit 110 and the detecting unit 120 are coupled. The configuration is given by way of example only and is not limited thereto. Alternatively, the applying unit 110 and the detecting unit 120 may be individually provided to the electrodes 102 and 103.

The control unit 130 controls an operation of each unit of the display device 100. Specifically, the control unit 130 includes a storage unit 131 and an arithmetic unit 132. The storage unit 131 is a storage device that stores therein a computer program 141 and temperature model data 142. The computer program 141 includes a computer program for controlling an operation of each unit of the display unit 101 and a computer program for executing a command based on the temperature of the electrodes 102 and 103 indicated by the electrical change detected by the detecting unit 120. The temperature model data 142 indicates the relation between the electric resistance of the electrodes 102 and 103 and the temperature of the electrodes 102 and 103. The use of the temperature model data 142 makes it possible to derive the temperature of the electrodes 102 and 103 from the electric resistance thereof. More specifically, the temperature model data 142 indicates, when an electric resistance of an electrode is a certain electric resistance (e.g., an electric resistance within a predetermined range), that the temperature of the electrode is a certain temperature (e.g., a temperature within a predetermined range or a temperature equal to or lower than a predetermined temperature) in accordance with an electric resistance of another electrode adjacent to the electrode.

A conductor has a higher electric resistance as the temperature thereof increases. Consequently, a rise in the temperature of the display unit 101 increases the temperature of the electrodes 102 and 103 provided to the display unit 101, which increases the electric resistance of the electrodes 102 and 103. In a case where the temperature distribution of the display surface 101*a* is uneven, the respective electric resistances of the electrodes 102 and 103 vary in different manners. Specifically, the electrodes 102 and 103 are aligned in the X-direction as described above. In a case where the temperature is uneven in the X-direction, the electric resistance of electrodes positioned at a portion having a higher temperature is made higher. In a case where the temperature is uneven in the Y-direction, temperature unevenness in the longitudinal direction (Y-direction) occurs in each of the electrodes 102 and 103. The electrodes 102 and 103 have a tapered structure in the Y-direction. In a case where the temperature unevenness occurs in the Y-direction when the temperature rises, for example, the temperature in some electrodes rises at a wider portion in the X-direction, whereas the temperature in others rises at a narrower portion, because of the tapered structure. In this case, the degree of increase in the electric resistance accompanying the increase in the temperature is greater in the electrodes the temperature of which rises at the wider portion than in the electrodes the temperature of which rises at the narrower portion. In other words, in a case where the temperature is uneven in the Y-direction on the display surface 101*a* because of an increase in the temperature, the electric resistance of one electrode of adjacent electrodes 102 and 103 included in an electrode array in which the electrodes 102 and the electrodes 103 are arranged alternately in the X-direction increases greatly because of an increase in the temperature at the wider portion of the one electrode. By contrast, the temperature of the other electrodes of the adjacent electrodes 102 and 103 rises at the narrower portion, not at the wider portion. As a result, the increase in the electric resistance of the other electrode is smaller than that of the one electrode. The difference between the electric resistances of the adjacent electrodes 102 and 103 is dependent on the position of the portion having a higher temperature in the Y-direction on the display surface 101*a*. In a case where the temperature locally increases at a portion closer to either one of both ends (the upper and the lower ends in FIG. 2) in the Y-direction on the display surface 101*a*, the difference between the electric resistances of the adjacent electrodes 102 and 103 increases.

As described above, the temperature distribution of the display surface 101*a* can be specified based on the electric resistance of the electrodes 102 and 103 varying depending on the temperature distribution in the X-direction and the Y-direction. Specifically, the average of the electric resistances of all the electrodes 102 and 103 varies depending on the amount of heat of the display surface 101*a*. The temperature unevenness in the X-direction generates a combination of the electrodes 102 and 103 having a relatively high electric resistance and a combination of the electrodes 102 and 103 having a relatively low electric resistance. The temperature unevenness in the Y-direction causes the electric resistance of one electrode out of a combination of the electrodes 102 and 103 to be relatively high, and it causes the electric resistance of the other electrode to be relatively low. Specifically, the electric resistance of the one electrode (the electrode 102 or the electrode 103) becomes relatively high because the temperature of the wider portion of the one electrode is relatively high; whereas the electric resistance of the other electrode (the electrode 102 or the electrode 103) becomes lower than that of the one electrode because the temperature of the narrower portion of the other electrode is relatively high. Based on these phenomena, data in which the temperature distribution of the display surface 101*a* is associated with the electric resistances of the electrodes 102 and 103 is prepared and stored as the temperature model data 142 (e.g., stored in the storage unit 131). As described above, by detecting the electric resistance of the electrodes 102 and 103, the temperature model data 142 corresponding to the detected electric resistance can be specified. By specifying the temperature model data 142, the temperature distribution of the display surface 101*a* can be specified.

When the temperature drops, the electric resistance decreases. Also in this case, unevenness in the temperature distribution causes unevenness in the temperature of the electrodes 102 and 103 and the variation in the electric resistance in association therewith. Regardless of an increase and a decrease in the temperature of the display surface 101*a*, the use of the electric resistance of the electrodes 102 and 103 and the temperature model data 142 makes it possible to specify the temperature distribution of the display surface 101*a*.

As described above, the control unit 130 executes the computer program 141, and uses the electric resistance of the electrodes 102 and 103 detected by the detecting unit 120 and the temperature model data 142. Thus, the control unit 130 specifies the temperatures of the electrodes 102 and 103 from the respective electric resistances thereof to execute a command based on the specified temperature. Specifically, the arithmetic unit 132 reads and executes the computer program 141 from the storage unit 131, thereby functioning as a specifying unit 135, an executing unit 136, and a determining unit 137. The specifying unit 135 performs an operation for specifying the temperature distribution of the display surface 101*a* corresponding to the electrical change (electric resistance) detected by the detecting unit 120. The executing unit 136 executes a predetermined command when there is a portion having a temperature equal to or higher than a predetermined temperature in the display surface 101*a*. Specifically, when there is a portion having a temperature equal to or higher than the predetermined temperature in the temperature distribution of the display surface 101*a* specified by the specifying unit 135, for example, the executing unit 136 executes a command (determination command) for causing the determining unit 137 to make a determination. The determining unit 137 determines whether the portion having a temperature equal to or higher than the predetermined temperature in the display surface 101*a* of the display unit 101 is in a designated area 101*g*, which is a partial area in the display surface 101*a*.

Figure 3:
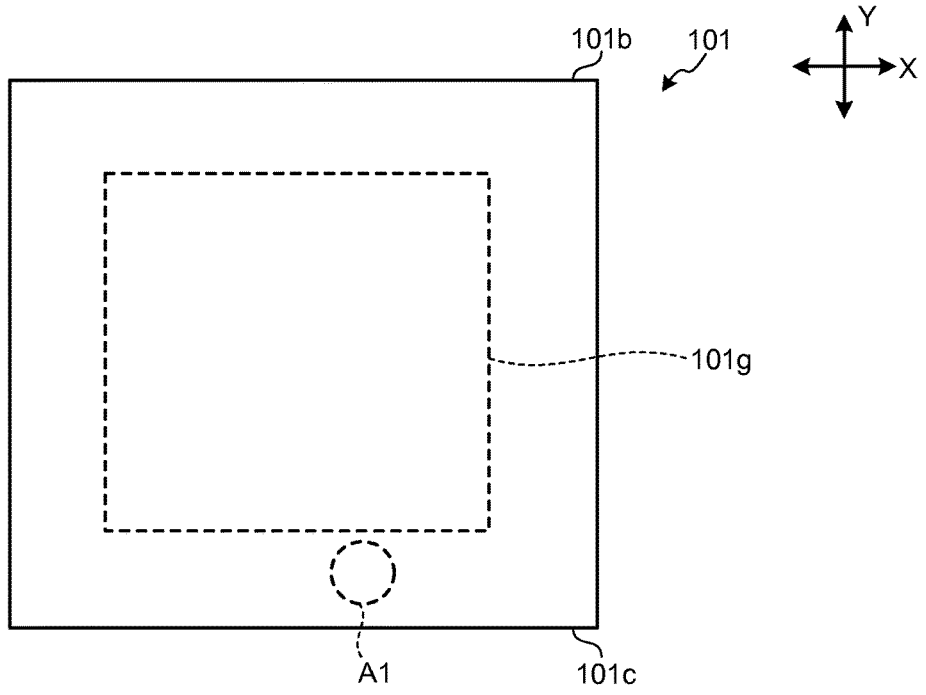
FIG. 3 is a schematic diagram of an example of a designated area in a display surface.

FIG. 3 is a schematic diagram of an example of the designated area 101*g* in the display surface 101*a*. The display unit 101 displays an image on an area (display area) in the display surface 101*a*. The designated area 101*g* is a partial area designated in the display area. Based on the result of the operation performed by the specifying unit 135, the determining unit 137 determines whether the portion having a temperature equal to or higher than the predetermined temperature (e.g., a spot A1 illustrated in FIG. 3) is in the designated area 101*g* in FIG. 3. If the determining unit 137 determines that the portion having a temperature equal to or higher than the predetermined temperature is in the designated area 101*g*, the executing unit 136 executes a display termination command to terminate display of the image performed by the display unit 101. If the display termination command is executed, the display unit 101 terminates the operation, thereby terminating display of the image, for example.

The specifying unit 135 does not necessarily perform the operation for specifying the temperature distribution of the entire display surface 101*a*. The specifying unit 135 may determine "whether there is a portion having a temperature equal to or higher than the predetermined temperature is in the display surface 101*a*" based on a pattern of the electric resistances indicated by the minimum combination of the electrodes 102 and 103 when there is a portion having a temperature equal to or higher than the predetermined temperature in the display surface 101*a*. The pattern, for example, is a combination of electric resistances $\phi$ and $\kappa$ indicated by a combination of an electrode 102 and an electrode 103 adjacent to each other. This operation is performed based on a result of preliminary measurement indicating that, when the temperature of any portion in the display surface 101*a* becomes a temperature equal to or higher than the predetermined temperature, a combination of the electrodes 102 and 103 always shows electric resistances equal to or higher than the combination of the electric resistances. If there is no combination of the electrodes 102 and 103 showing electric resistances higher than those of the pattern, it is determined that there is no portion having a temperature equal to or higher than the predetermined temperature in the display surface 101*a*. By contrast, if there is a combination of the electrodes 102 and 103 showing electric resistances higher than those of the pattern, the specifying unit 135 determines that there is a portion having a temperature equal to or higher than the predetermined temperature in the display surface 101*a*. In this case, the executing unit 136 outputs a determination command. The determining unit 137 causes the specifying unit 135 to perform an operation for specifying the temperature distribution of the display surface 101*a*. Also in this operation, the specifying unit 135 need not perform the operation for specifying the temperature distribution both in the X-direction and the Y-direction at a time. First, the specifying unit 135 specifies which combination of the electrodes 102 and 103 corresponds to the portion having a temperature equal to or higher than the predetermined temperature in the X-direction. If it is determined that the specified portion having a temperature equal to or higher than the predetermined temperature is outside the designated area 101*g* at this time, the determining unit 137 causes the specifying unit 135 to terminate the operation. The determining unit 137 transmits information indicating that the portion having a temperature equal to or higher than the predetermined temperature is outside the designated area 101*g* to the executing unit 136. In this case, the executing unit 136 does not output any more commands. By contrast, if the position of the portion in the X-direction is located in the designated area 101*g* in the X-direction, the specifying unit 135 specifies the position of the portion in the Y-direction that has a temperature equal to or higher than the predetermined temperature. The determining unit 137 determines whether the specified position is located in the designated area 101*g* and transmits information indicating the determination result to the executing unit 136. If the executing unit 136 receives information of the determination result indicating that the specified position is located in the designated area 101*g*, the executing unit 136 outputs the display termination command. By gradually performing the operation in this manner, the amount of operation performed by the specifying unit 135 can be minimized. The designated area 101*g* may be set as a given area in the display surface 101*a*.

Although the predetermined temperature is a nematic-isotropic transition temperature of the liquid crystals provided to the display unit 101, for example, this is given by way of example only and is not limited thereto and may be appropriately changed. The predetermined temperature may be set to a high temperature at or beyond which the operation of the display unit 101 may possibly be hindered on the display surface 101*a*. The executing unit 136 outputting the display termination command based on the predetermined temperature makes it possible to prevent an abnormality in display.

Figure 4:
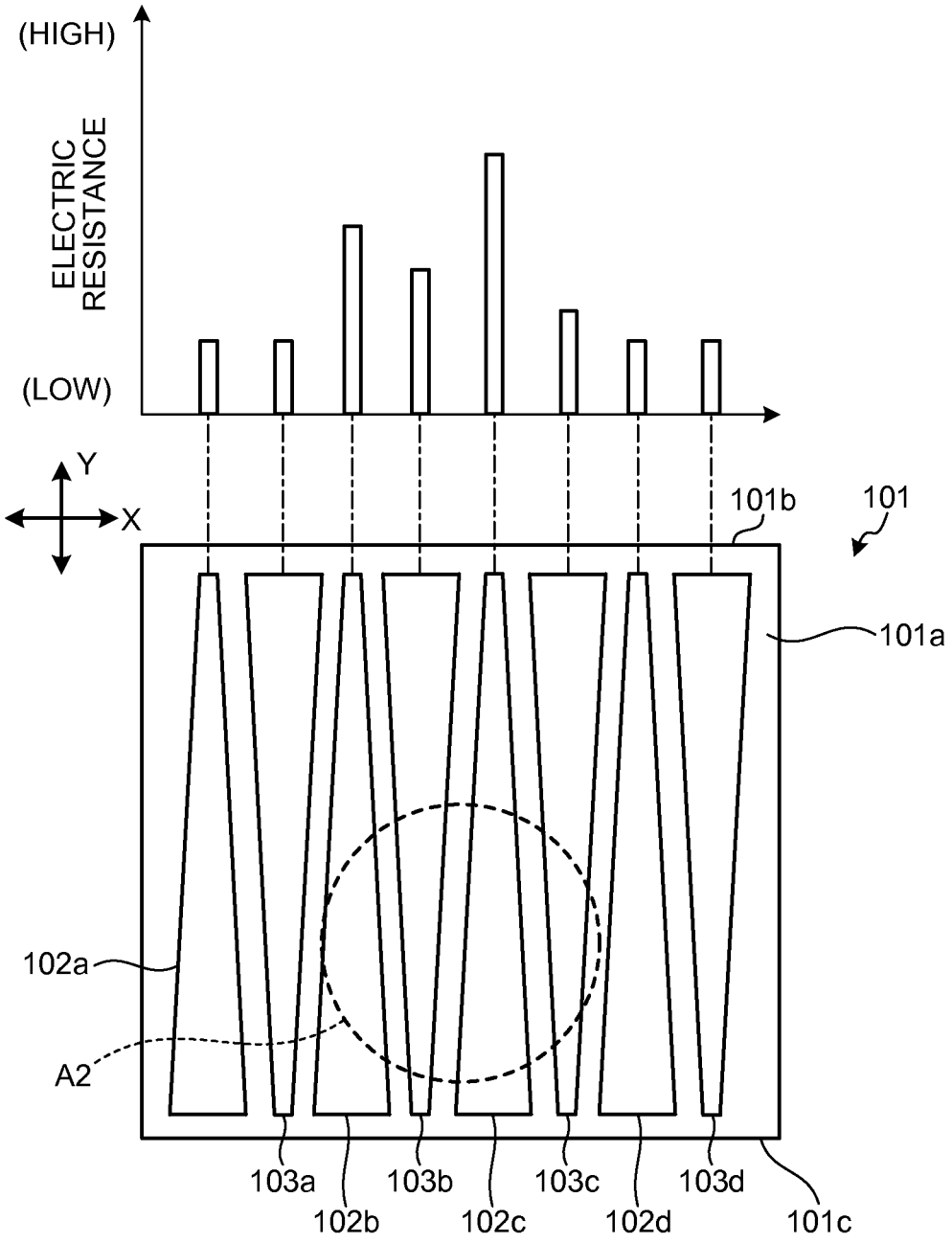
FIG. 4 is a diagram of an example of the correspondence relation between temperature unevenness of the display surface and a detection result of electric resistances of the electrodes according to the first embodiment.

The following describes an example of the correspondence relation between temperature unevenness of the display surface 101*a* and a detection result of the electric resistances of the electrodes 102 and 103 according to the first embodiment with reference to FIG. 4. In FIG. 4, the electrodes 102 are denoted by 102*a*, 102*b*, 102*c*, and 102*d* from the left in order for distinction, whereas the electrodes 103 are denoted by 103*a*, 103*b*, 103*c*, and 103*d* from the left in order. A circular spot A2 illustrated in the lower figure in FIG. 4, for example, is positioned at the center of the display surface 101*a* in the X-direction and closer to the lower side 101*c* in the Y-direction. The upper figure in FIG. 4 illustrates the relation between the magnitudes of the respective electric resistances of the electrodes 102 and 103 in a case where the temperature of the spot A2 in the display surface 101*a* is higher than that of the other portion in the display surface 101*a*. In other words, the electric resistances of four electrodes 102*b*, 102*c*, 103*b*, and 103*c* partially included in the spot A2 are higher than those of the other electrodes 102*a*, 102*d*, 103*a*, and 103*d* not included in the spot A2. The electric resistances of the two electrodes 102*b* and 102*c* included in the four electrodes are higher because their relatively wider portion in the tapered structure is included in the spot A2. By contrast, the electric resistances of the two electrodes 103*b* and 103*c* are lower than those of the electrodes 102*b* and 102*c* because their relatively narrower portion in the tapered structure is included in the spot A2. The electric resistance of the electrode 102*c* out of the two electrodes 102*b* and 102*c* is higher than that of the electrode 102*b* because its area included in the spot A2 is larger than that of the electrode 102*b*. Similarly, the electric resistance of the electrode 103*b* out of the two electrodes 103*b* and 103*c* is higher than that of the electrode 103*c* because its area included in the spot A2 is larger than that of the electrode 103*c*. As described above, the electrodes are arranged side by side so that the first electrodes (e.g., the electrodes 102) tapered toward one side and the second electrodes (e.g., the electrodes 103) tapered toward the other side opposite to the one side are alternately arranged. Thus the display device 100 can detect the electric resistances of the electrodes depending on the position of the spot A2. In other words, the display device 100 can specify the temperature distribution of the display surface 101*a* based on the electric resistances.

Although the electrodes 102 and 103 do not necessarily have the same shape, forming the electrodes 102 and 103 into the same shape makes it possible to equalize the electric resistance under the same temperature condition as illustrated in FIG. 4. This structure can facilitate the grasp of the electric resistance of the electrodes 102 and 103 under the same temperature condition.

Figure 5:
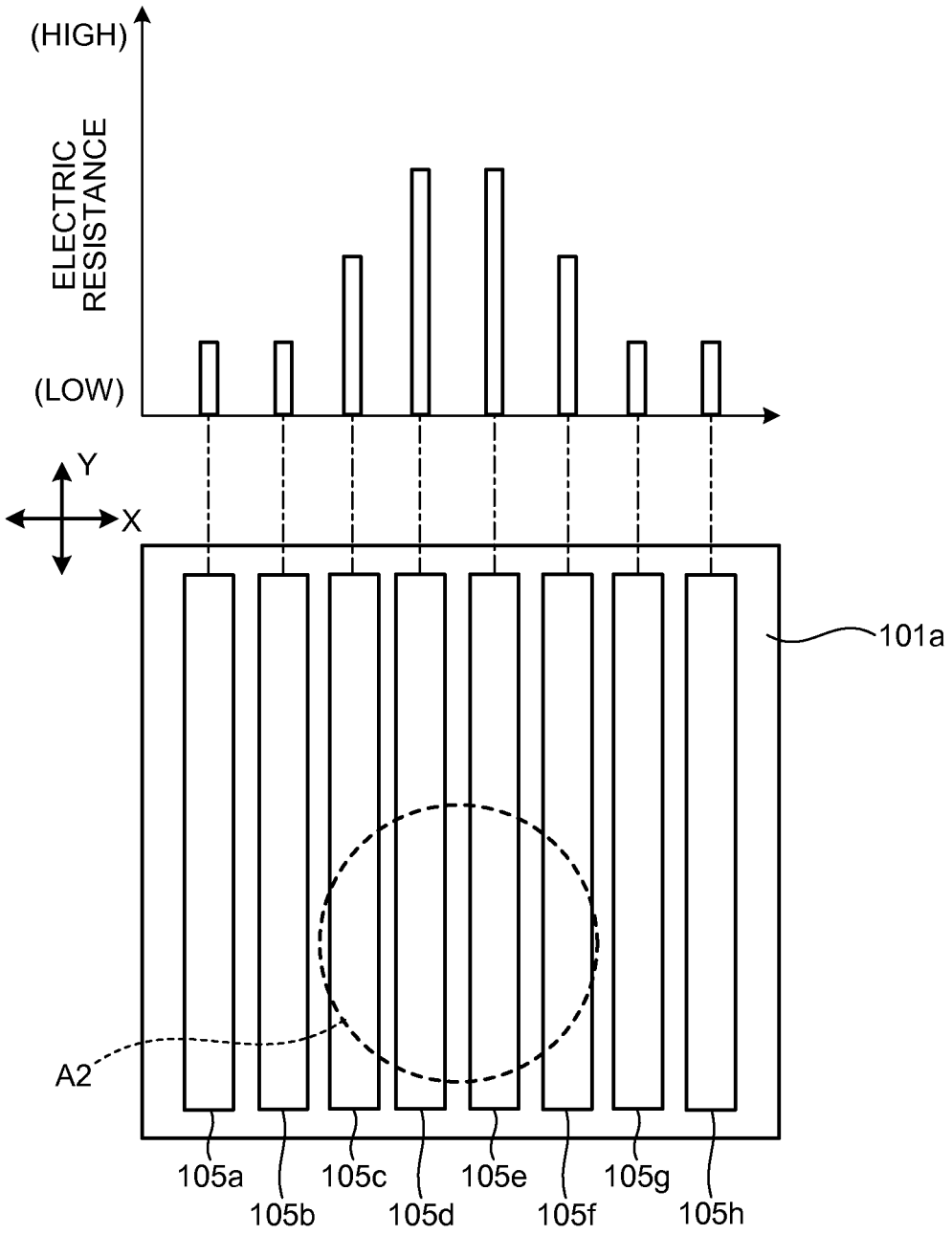
FIG. 5 is a diagram of an example of the correspondence relation between temperature unevenness of a display surface and a detection result of electric resistances of electrodes according to a comparative example where only electrodes having no tapered structure and having a uniform shape in the Y-direction are arranged side by side in the X-direction.

The following describes a comparative example where only electrodes 105*a* to 105*h* are arranged side by side in the X-direction with reference to FIG. 5. The electrodes 105*a* to 105*h* do not have a tapered structure but a uniform shape in the Y-direction. The position of the spot A2 illustrated in the lower figure in FIG. 5 is the same as that of the spot A2 illustrated in FIG. 4. The upper figure in FIG. 5 illustrates the relation between the magnitudes of the respective electric resistances of the electrodes 105 in a case where the electrodes 105*a* to 105*h* having a uniform shape in the Y-direction are arranged side by side in the X-direction as illustrated in the lower figure in FIG. 5. In other words, the electric resistances of four electrodes 105*c*, 105*d*, 105*e*, and 105*f* partially included in the spot A2 are higher than those of the other electrodes 105*a*, 105*b*, 105*g*, and 105*h* not included in the spot A2. The electric resistances of the four electrodes 105*c*, 105*d*, 105*e*, and 105*f*, however, do not change depending on the position of the spot A2 in the Y-direction. In other words, in a case where only the electrodes 105*a* to 105*h* having a uniform shape in the Y-direction are arranged side by side in the X-direction, the position of the spot A2 in the Y-direction cannot be specified. By contrast, the electric resistances of the four electrodes 102$b$, 102$c$, 103$b$, and 103$c$ according to the first embodiment each differ depending on the position of the spot A2 in the Y-direction as illustrated in FIG. 4. Thus, the position of the spot A2 in the Y-direction can be specified based on the difference.

Figure 6:
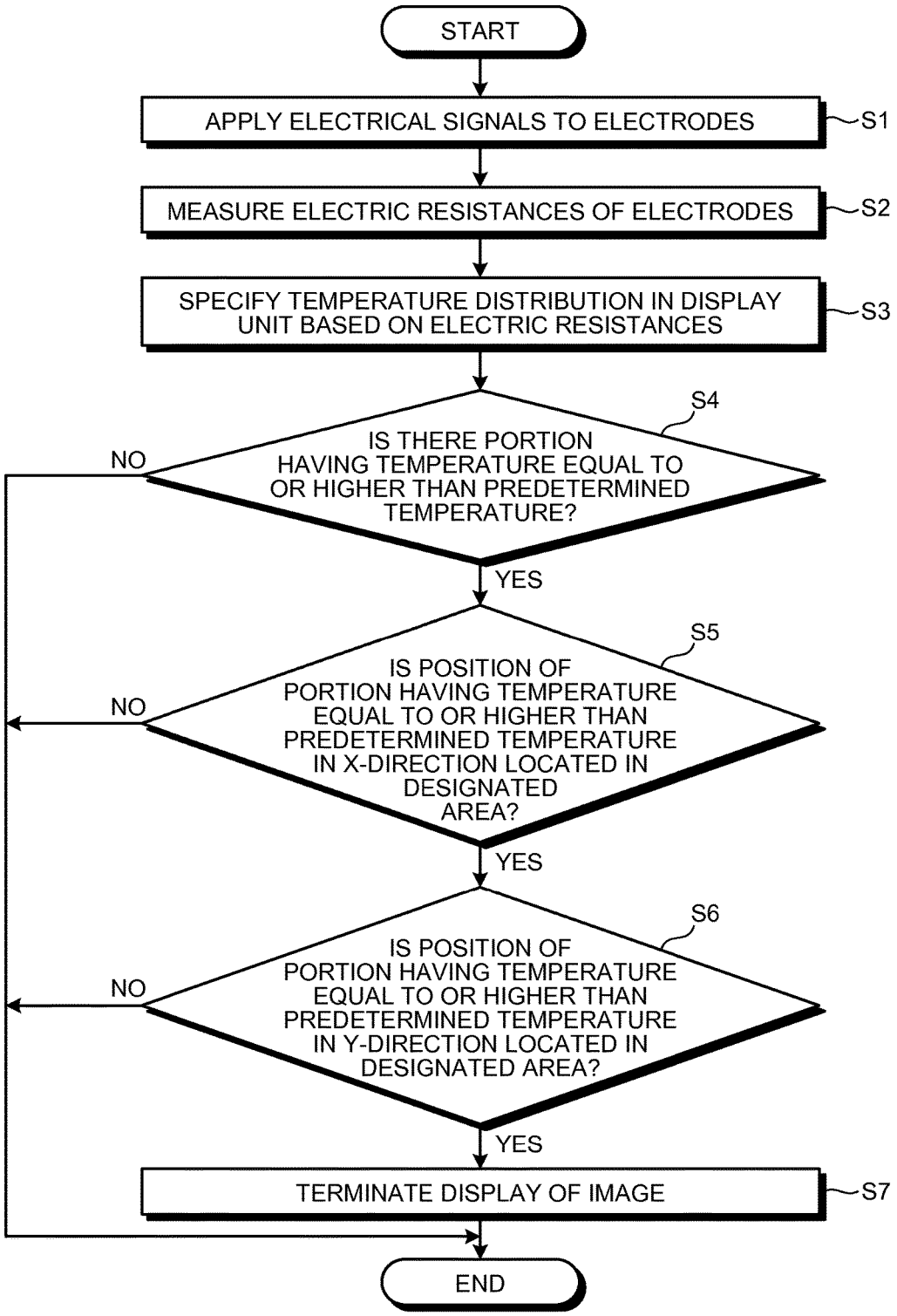
FIG. 6 is a flowchart of an exemplary flow of specifying the temperature distribution of the display surface and processing performed after specifying the temperature distribution.

FIG. 6 is a flowchart of an exemplary flow of specifying the temperature distribution of the display surface 101$a$ and processing performed after specifying the temperature distribution. The applying unit 110 applies electrical signals to the electrodes 102 and 103 (Step S1). The detecting unit 120 detects (measures) the electric resistances of the electrodes 102 and 103 caused by the electrical signals applied at Step S1 (Step S2). The specifying unit 135 specifies the temperature distribution of the display unit 101 based on the electrical change (electric resistance) detected at Step S2 (Step S3).

The executing unit 136 determines whether there is a portion having a temperature equal to or higher than the predetermined temperature in the temperature distribution of the display unit 101 specified at Step S3 (Step S4). If there is a portion having a temperature equal to or higher than the predetermined temperature (Yes at Step S4), the executing unit 136 executes the determination command. In response to the determination command, the determining unit 137 determines whether the portion having a temperature equal to or higher than the predetermined temperature is in the designated area 101$g$. Specifically, the determining unit 137, for example, determines whether the portion having a temperature equal to or higher than the predetermined temperature is in the designated area 101$g$ in the X-direction (Step S5). If the determining unit 137 determines that the portion having a temperature equal to or higher than the predetermined temperature is in the designated area 101$g$ in the X-direction (Yes at Step S5), the determining unit 137 determines whether the portion having a temperature equal to or higher than the predetermined temperature is in the designated area 101$g$ in the Y-direction (Step S6). If the determining unit 137 determines that the portion having a temperature equal to or higher than the predetermined temperature is in the designated area 101$g$ in the Y-direction (Yes at Step S6), the executing unit 136 executes the display termination command. In response to the display termination command, the display unit 101 terminates display of an image (Step S7). In a case where there is no portion having a temperature equal to or higher than the predetermined temperature (No at Step S4), if the determining unit 137 determines that the portion having a temperature equal to or higher than the predetermined temperature is not in the designated area 101$g$ in the X-direction (No at Step S5), or if the determining unit 137 determines that the portion having a temperature equal to or higher than the predetermined temperature is not in the designated area 101$g$ in the Y-direction (No at Step S6), any particular operational control is not performed based on the temperature distribution of the display unit 101.

As described above, the electrodes according to the first embodiment include the first electrodes (e.g., the electrodes 102) tapered toward one side in the second direction (e.g., the Y-direction) and the second electrodes (e.g., the electrodes 103) tapered toward the other side opposite to the one side. The first electrodes and the second electrodes are alternately arranged side by side in the first direction (e.g., the X-direction). With this configuration, it is possible to specify the temperature distribution in the first direction based on the respective electric resistances of the electrodes and the temperature distribution in the second direction based on the difference between the electric resistances of the first electrodes and those of the second electrodes. Thus, the first embodiment can specify the temperature distribution of the display surface (e.g., the display surface 101$a$).

In a case where there is a portion having a temperature equal to or higher than the predetermined temperature in the display surface, the first embodiment executes a predetermined command to control the operation of the display device depending on the temperature of the display surface.

In a case where the portion having a temperature equal to or higher than the predetermined temperature is in the designated area (e.g., the designated area 101$g$) of the display surface, the display unit terminates display of an image, which can prevent a problem relating to display of the image caused by an increase in the temperature to the predetermined temperature or higher from occurring in the designated area. Consequently, when performing important display that does not allow disturbance in the display of an image in the designated area, for example, the first embodiment can more reliably and normally display the contents of the image displayed in the designated area.

The use of transparent electrodes as the electrodes makes it possible to prevent light that allows a user to view the image from being blocked by the electrodes. The arrangement of the electrodes in the display unit allows the display unit to be integrally manufactured with the electrodes. This configuration can reduce the number of assembly processes for the display device (e.g., the display device 100) and downsize the display device.

Figure 7:
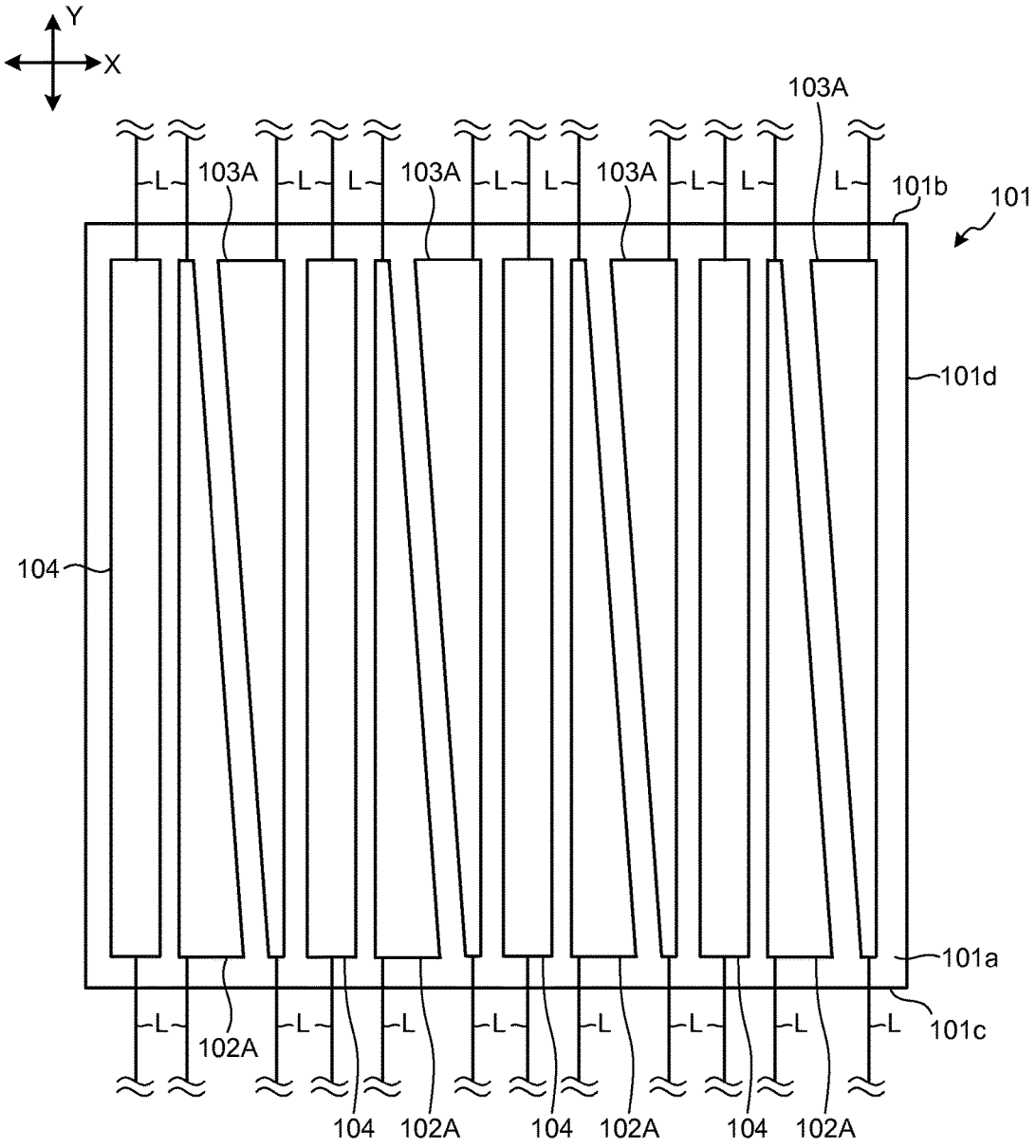
FIG. 7 is a schematic diagram of the shape of a plurality of electrodes including reference electrodes and an arrangement example thereof.

A second embodiment according to the present invention will be described with reference to FIGS. 7 and 8. FIG. 7 is a schematic diagram of the shape of a plurality of electrodes 102A, 103A, and 104 and an arrangement example thereof. The electrodes 104 are reference electrodes. The display device according to the second embodiment is the same as that according to the first embodiment except that the electrodes 102A, 103A, and 104 are provided to the display unit 101 instead of the electrodes 102 and 103 according to the first embodiment.

The display device according to the second embodiment includes the electrodes 102A, 103A, and 104. The electrodes 104 are reference electrodes having a uniform shape in the second direction (e.g., the Y-direction). "Uniform" means that the width and the thickness in a direction orthogonal to the second direction (e.g., the width in the X-direction and the thickness in the Z-direction) or the diameter of a cross section orthogonal to the second direction is uniform in the second direction. Specifically, as illustrated in FIG. 7, the electrodes 104 have a rectangular shape the longitudinal direction of which extends in the Y-direction. The thickness of the electrodes 104 in the Z-direction is uniform over the whole body in the Y-direction.

Similarly to the electrodes 102 and 103 according to the first embodiment, the electrodes 102A, 103A, and 104 according to the second embodiment are thin-film electrodes the longitudinal direction of which extends along the Y-direction. Similarly to the electrodes 102 and 103 according to the first embodiment, the electrodes 102A and 103A according to the second embodiment are tapered in the second direction (e.g., the Y-direction). While the electrodes 102 and 103 according to the first embodiment have an isosceles trapezoidal tapered structure, the electrodes 102A and 103A according to the second embodiment have a right triangular tapered structure as illustrated in FIG. 7.

The electrode 104 serving as a reference electrode is arranged between a first electrode (e.g., the electrode 102A) and a second electrode (e.g., the electrodes 103A) that are arranged side by side in the first direction (e.g., the X-direction). Specifically, as illustrated in FIG. 7, the electrode 104 is arranged at a position interposed between respective sides of the electrodes 102A and 103A having a right triangular tapered structure, the sides each forming a right angle and extending along the Y-direction. The electrodes 102A and 103A according to the second embodiment are arranged such that the respective longest sides opposite to the right angle are arranged adjacent to each other. The electrode 104 serving as the reference electrode is not arranged between the longest sides. As described above, the reference electrodes 104 are intermittently arranged between the first electrodes (e.g., the electrodes 102A) and the second electrodes (e.g., the electrodes 103A) that are arranged side by side in the first direction (e.g., the X-direction). The arrangement of the electrodes 102A, 103A and 104 illustrated in FIG. 7 can minimize the gap between the electrodes 102A, 103A and 104. In other words, it is possible to arrange the electrodes 102A, 103A and 104 more densely. This arrangement can increase the resolution in the temperature distribution using the electrodes including the reference electrodes.

Figure 8:
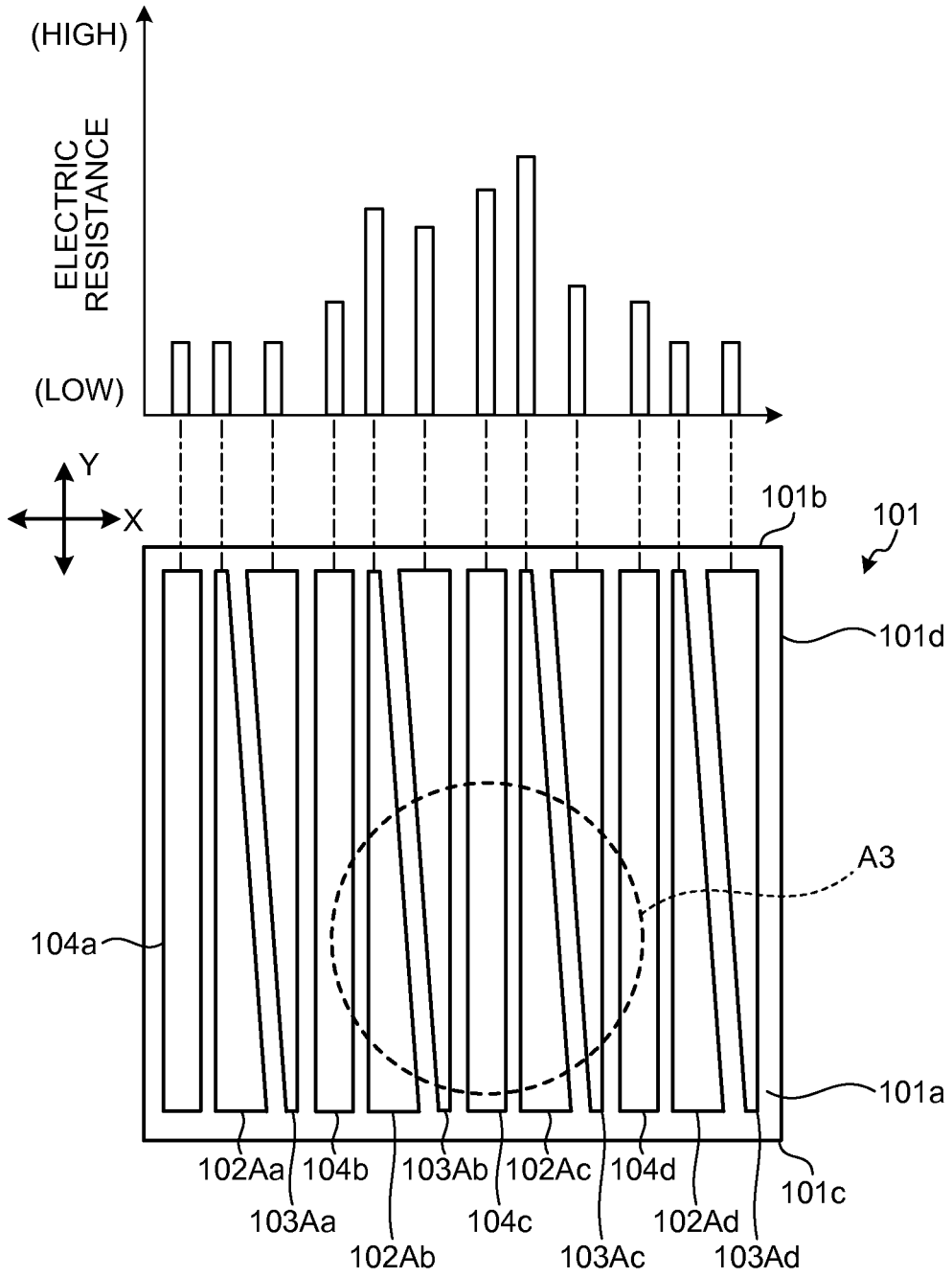
FIG. 8 is a diagram of an example of the correspondence relation between temperature unevenness of the display surface and a detection result of the electric resistances of the electrodes according to a second embodiment.

The following describes an example of the correspondence relation between temperature unevenness of the display surface 101*a* and a detection result of the electric resistances of the electrodes 102A, 103A, and 104 according to the second embodiment with reference to FIG. 8. In FIG. 8, the electrodes 102A are denoted by 102Aa, 102Ab, 102Ac, and 102Ad from the left in order for distinction. The electrodes 103A are denoted by 103Aa, 103Ab, 103Ac, and 103Ad from the left in order. The electrodes 104 are denoted by 104*a*, 104*b*, 104*c*, and 104*d* from the left in order. A circular spot A3 illustrated in the lower figure in FIG. 8 is positioned closer to a right side 101*d* with respect to the center of the display surface 101*a* in the X-direction and closer to the lower side 101*c* in the Y-direction. The upper figure in FIG. 8 illustrates the relation between the magnitudes of the respective electric resistances of the electrodes 102A, 103A, and 104 in a case where the temperature of the spot A3 in the display surface 101*a* is higher than that of the other portion in the display surface 101*a*. In other words, the electric resistances of seven electrodes 102Ab, 102Ac, 103Ab, 103Ac, 104*b*, 104*c*, and 104*d* partially included in the spot A3 are higher than those of the other electrodes 102Aa, 102Ad, 103Aa, 103Ad, and 104*a* not included in the spot A3. The electric resistances of the two electrodes 102Ab and 102Ac out of the seven electrodes are higher because their relatively wider portion in the tapered structure is included in the spot A3. By contrast, the electric resistances of the two electrodes 103Ab and 103Ac are lower than those of the electrodes 102Ab and 102Ac because their relatively narrower portion in the tapered structure is included in the spot A3. The electric resistance of the electrode 102Ac out of the two electrodes 102Ab and 102Ac is higher than that of the electrode 102Ab because its area included in the spot A3 is larger than that of the electrode 102Ab. Similarly, the electric resistance of the electrode 103Ab out of the two electrodes 103Ab and 103Ac is higher than that of the electrode 103Ac because its area included in the spot A3 is larger than that of the electrode 103Ac. As described above, the first electrodes (e.g., the electrodes 102A) tapered toward one side and the second electrodes (e.g., the electrodes 103A) tapered toward the other side opposite to the one side are alternately arranged side by side, so that display device can detect the electric resistances of the electrodes depending on the position of the spot A3. The electric resistances of the reference electrodes 104*a*, 104*b*, 104*c*, and 104*d* having a uniform shape in the Y-direction decrease in descending order of the areas of the electrodes included in the spot A3 (e.g., in order of the electrodes 104*c*, 104*d*, 104*b*, and 104*a*). The electric resistances of the respective reference electrodes (electrodes 104*a* to 104*d*) vary depending on the position of the spot A3 in the X-direction. In other words, the use of the reference electrodes can make it easier to specify the temperature distribution in the X-direction on the display surface 101*a*. Thus, the second embodiment can make it easier to specify the temperature distribution of the display surface 101*a* based on the electric resistances of the electrodes 102A, 103A, and 104.

A part of the reference electrodes is not necessarily interposed between the electrode 102A and the electrode 103A like the electrode 104*a* illustrated in FIG. 8. The reference electrodes may be arranged at desired intervals required to specify the temperature distribution in the first direction (X-direction).

As described above, the reference electrodes (e.g., the electrodes 104) according to the second embodiment has a uniform shape in the second direction (e.g., the Y-direction). The reference electrodes are arranged between the first electrodes (e.g., the electrodes 102A) and the second electrodes (e.g., the electrodes 103A) that are arranged side by side in the first direction (e.g., the X-direction). This arrangement can make it easier to specify the temperature distribution in the first direction based on the electric resistances of the reference electrodes. Thus, the second embodiment can make it easier to specify the temperature distribution of the display surface (e.g., the display surface 101*a*).

The reference electrodes are arranged intermittently between the first electrodes and the second electrodes that are arranged side by side in the first direction. Thus, the reference electrodes can be arranged without occupying the space where the first electrodes and the second electrodes are to be provided.

The following describes application examples of the display device according to the embodiments above with reference to FIGS. 9 to 15. The display device according to the embodiments above is applicable to electronic apparatuses of all fields, such as head-up display devices (HUDs), in-vehicle display devices, and smartphones. In other words, the display device is applicable to electronic apparatuses of all fields that display video signals received from the outside or video signals generated inside thereof as an image or video.

First Application Example

Figure 9:
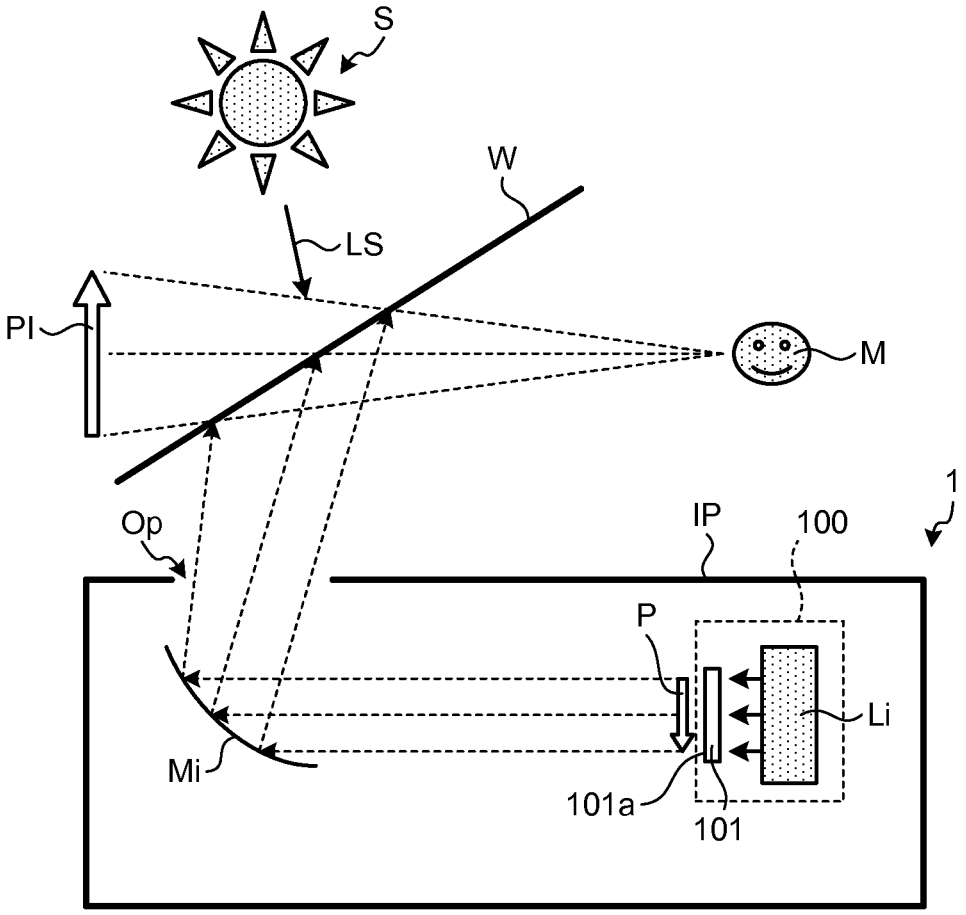
FIG. 9 is a schematic diagram of a head-up display device to which the display device according to the present invention is applied.

FIG. 9 is a schematic diagram of an HUD 1 to which the display device according to the present invention is applied. The HUD 1 is mounted on vehicles, such as cars, buses, and trucks, and displays information on a projection plane, such as a windshield of a vehicle. A driver M of the vehicle can view the information displayed on a windshield W almost without turning his/her eyes away from the front view.

The HUD 1 includes the display device 100 and a mirror Mi. The display device 100 includes a light source Li, the display unit 101 provided with a plurality of electrodes (e.g., the electrodes 102 and 103 or the electrodes 102A, 103A, and 104), and the units included in the display device 100 not illustrated in FIG. 9. The light source Li is a light emitting diode (LED), for example, but is not limited thereto. The display unit 101 is a liquid crystal display panel, for example, but is not limited thereto. The mirror Mi is a concave mirror that projects an image in the display device 100 onto the projection plane, such as the windshield W. The mirror Mi is not necessarily provided, and the image in the display device 100 may be directly projected onto the windshield W. Alternatively, the image may be projected onto the windshield W via a plurality of mirrors Mi. The HUD 1 has an opening Op at a position facing the windshield W and the mirror Mi.

An image P projected by the display unit 101 is reflected by the mirror Mi and then projected onto the windshield W through the opening Op. The Mirror Mi enlarges and projects the image P onto the windshield W. The driver M views a virtual image PI of the image P projected by the display unit 101 through the windshield W.

The windshield W of the vehicle is irradiated with light (sunlight) LS from the sun S. The sunlight LS incident on the windshield W is transmitted through the opening Op of the HUD 1, reflected by the mirror Mi, and is incident on the display unit 101. As described above, the mirror Mi enlarges the image P displayed by the display unit 101 when reflecting it and projects the image P onto the windshield W. The sunlight LS transmitted from the windshield W is reduced by the mirror Mi and is incident on the display unit 101.

The display unit 101 is heated by infrared rays included in the sunlight LS. The mirror Mi condenses the sunlight LS, thereby increasing the energy density of the infrared rays incident on the display unit 101. The display unit 101 is housed in a front panel IP of the vehicle, and is used in an environment where the heat is likely to persist. In other words, the display unit 101 is used in an environment where the temperature is likely to rise. By contrast, in a case where the display unit 101 is placed under a low-temperature environment where no sunlight LS is incident, the temperature of the display unit 101 remains low. Because the display device 100 is the display device according to the first embodiment, the display device 100 can perform operational control depending on the temperature of the display unit 101.

In the HUD 1, the sunlight LS is collected by the mirror Mi under an environment where the sunlight LS is incident, and is more likely to be concentrated at the center portion of the display surface 101*a* of the display unit 101. Accordingly, the electrodes may be arranged only in the center portion in the X-direction of the display surface 101*a* where the temperature is likely to rise, for example. Alternatively, while the electrodes are arranged in the whole area in the X-direction on the display surface 101*a*, more electrodes may be arranged intensively and densely in such a portion.

Second Application Example

The electrodes according to the present invention may also be used as electrodes for touch detection. Specifically, touch detection electrodes in a capacitance touch panel may be used as the electrodes according to the present invention. In other words, the electrodes for an input function in the display device according to the present invention may also be used as the electrodes for specifying the temperature distribution.

Figure 10:
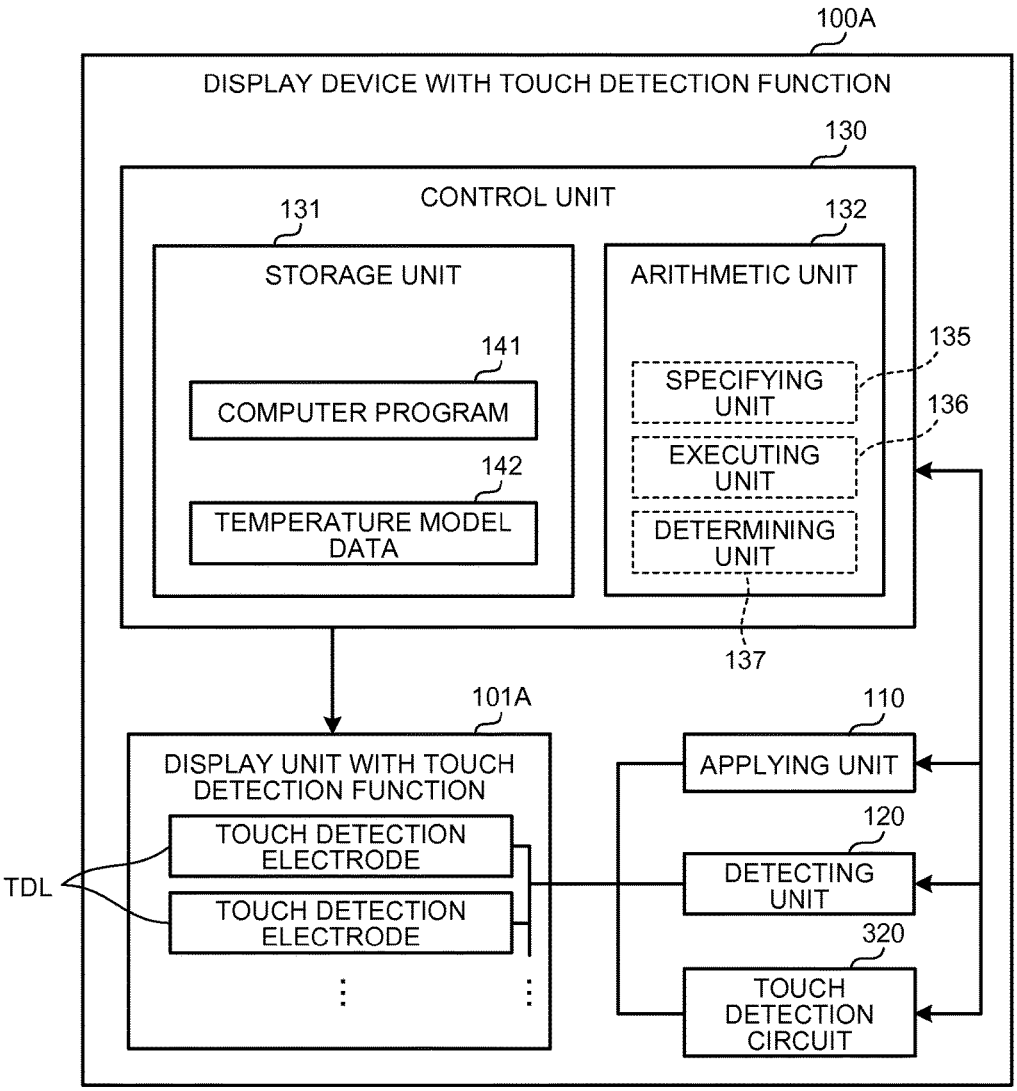
FIG. 10 is a block diagram of a configuration relating to major functions of a display device with a touch detection function.

The following describes an example of the display device according to the present invention, more specifically, an example where touch detection electrodes in a capacitance touch panel are used as the electrodes according to the present invention with reference to FIGS. 10 to 13. FIG. 10 is a block diagram of a configuration relating to major functions of a display device 100A with a touch detection function. The display device 100A with a touch detection function includes a display unit 101A with a touch detection function instead of the display unit 101 in the configuration of the first embodiment (or the second embodiment), for example. The display device 100A with a touch detection function further includes a touch detection circuit 320. The touch detection circuit 320 detects a signal (touch detection signal) generated in a touch detection electrode TDL depending on a change in the capacitance caused by a contact from the outside or proximity scanning on a display surface, thereby detecting a touch. The touch detection circuit 320 is provided as a circuit mounted on an external substrate coupled to the display unit 101A with a touch detection function via an FPC (e.g., an FPC 5) and the like.

Figure 11:
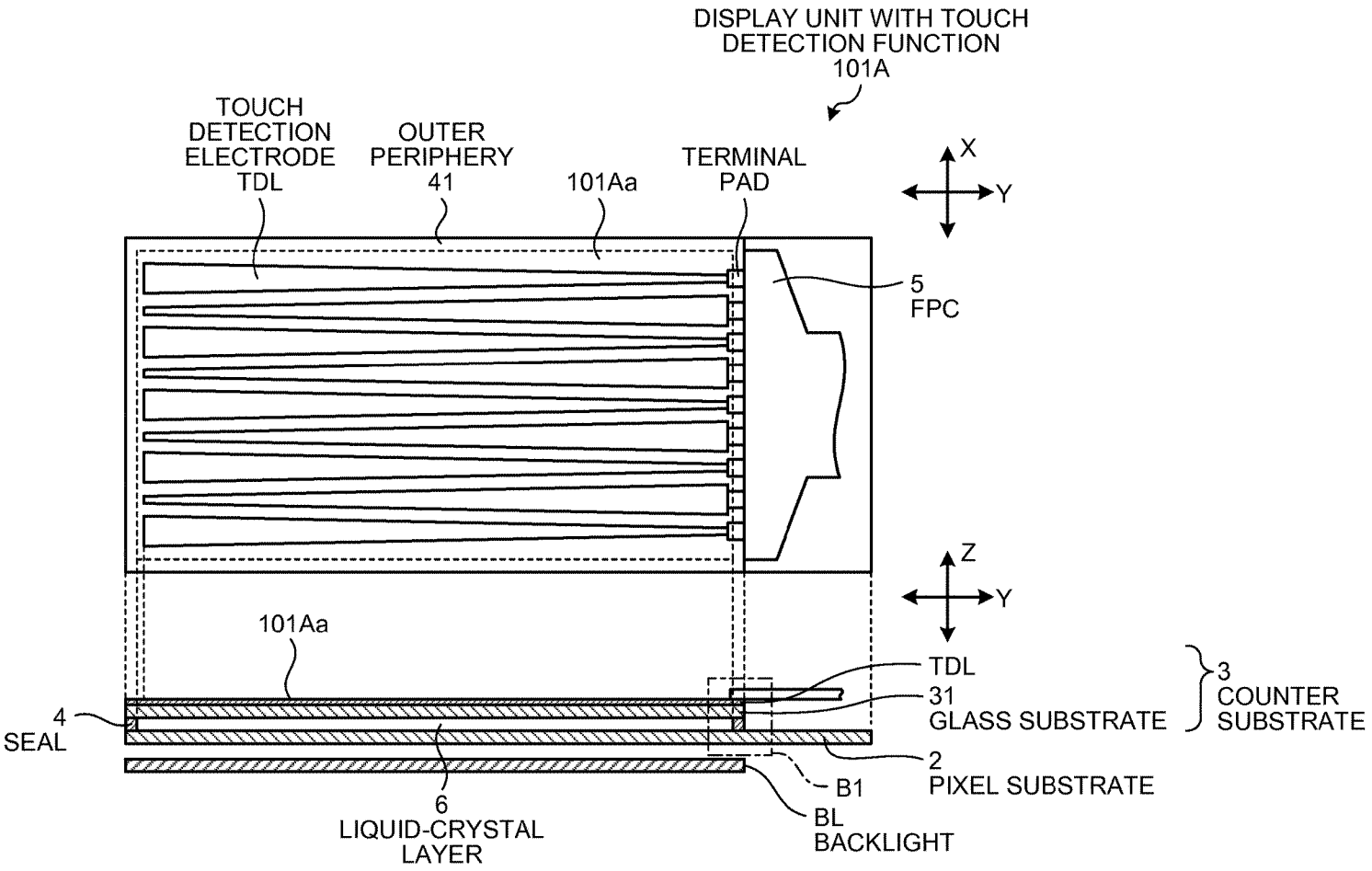
FIG. 11 is a schematic diagram of an exemplary configuration of a display unit with a touch detection function according to an application example.
Figure 12:
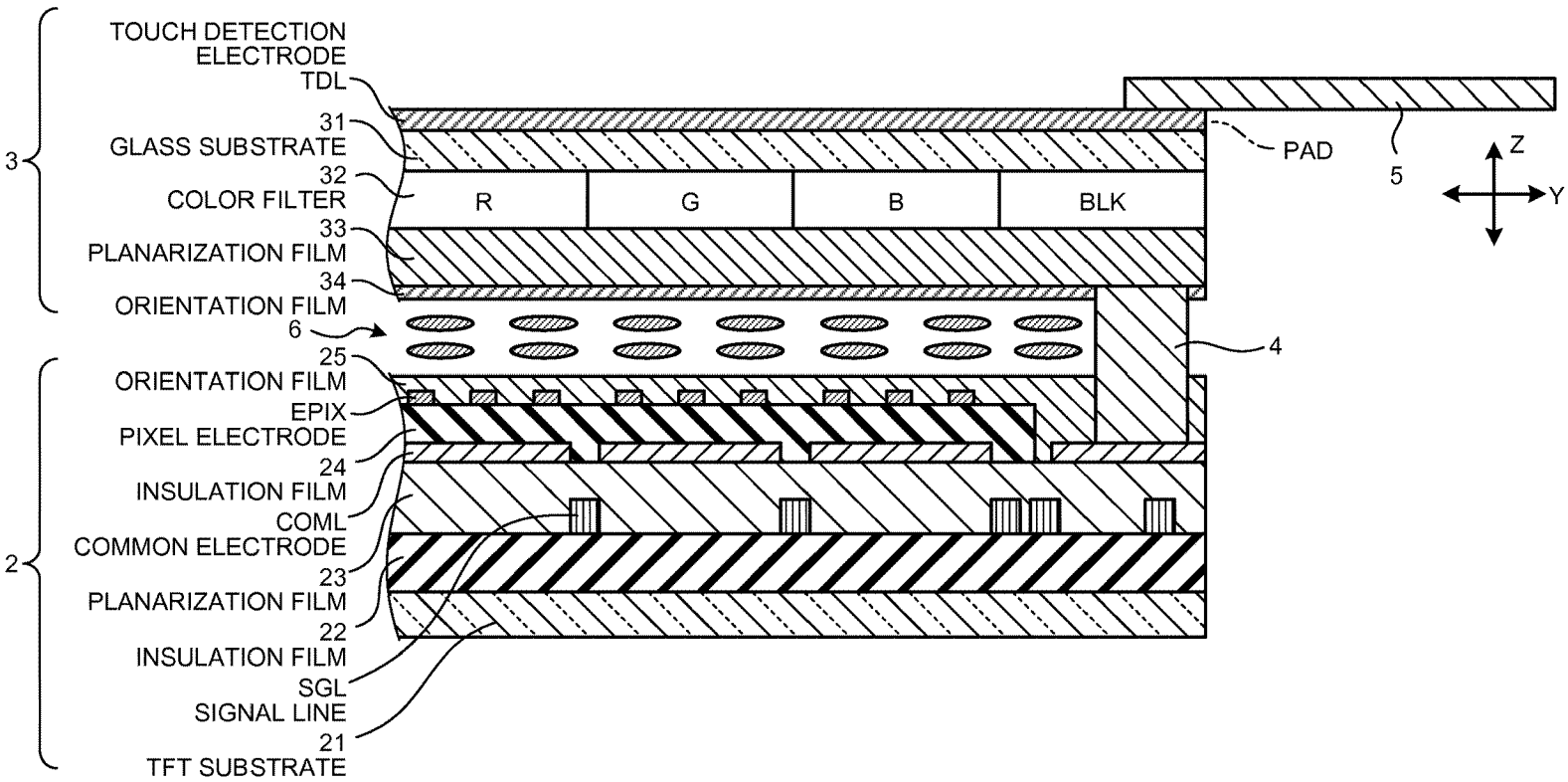
FIG. 12 is a schematic diagram of an example of a sectional structure of a main portion (portion B1) in FIG. 11.

FIG. 11 illustrates an exemplary configuration of the display unit 101A with a touch detection function according to a second application example of the present invention. FIG. 12 illustrates an example of a sectional structure of a main portion (portion B1) in FIG. 11. The display unit 101A with a touch detection function is provided with liquid crystal display elements as display elements. The display unit 101A with a touch detection function is what is called an in-cell device obtained by integrating a liquid crystal display device composed of the liquid crystal display elements and a capacitance touch detection device. The display unit 101A with a touch detection function includes a pixel substrate 2, a counter substrate 3, the FPC 5, a liquid crystal layer 6, a seal 4, and a backlight BL.

As illustrated in FIG. 12, the pixel substrate 2 includes a thin film transistor (TFT) substrate 21 serving as a circuit board, common electrodes COML, and pixel electrodes EPIX. The TFT substrate 21 serves as a circuit board provided with various electrodes, wiring, and TFTs, for example. The TFT substrate 21 is made of a glass, for example. An insulation film 22 is formed on the TFT substrate 21, and signal lines SGL are formed on the insulation film 22. A planarization film 23 made of an acrylic organic resin, for example, is formed on the signal lines SGL, and the common electrodes COML are formed on the planarization film 23. The common electrodes COML are translucent electrodes that supply a common voltage to a plurality of pixels Pix (not illustrated). The common electrodes COML are also used as electrodes of a touch sensor to which alternate current (AC) rectangular waves Sg are applied. In other words, the common electrodes COML correspond to drive electrodes of an input device that performs capacitance touch detection. An insulation film 24 is formed on the common electrodes COML, and the pixel electrodes EPIX are formed on the insulation film 24. The pixel electrodes EPIX are translucent electrodes that are supplied with pixel signals for performing display. The common electrodes COML and the pixel electrodes EPIX are made of an ITO, for example. An orientation film 25 is formed on the pixel electrodes EPIX.

As illustrated in FIG. 12, the counter substrate includes a glass substrate 31, a color filter 32, and touch detection electrodes TDL. The color filter 32 is formed on one surface of the glass substrate 31. The color filter 32 is composed of color filter layers of three colors of red (R), green (G), and blue (B), for example, periodically arrayed with a black matrix (BLK). The three colors of R, G, and B correspond to respective display pixels as a group. A group of the three colors of R, G, and B is given as an example of the color filter 32 according to the embodiment. Alternatively, a group of four colors of white and complementary colors (e.g., cyan, magenta, and yellow) of the three colors (e.g., R, G, and B) may be used. A planarization film 33 made of an acrylic resin, for example, is formed on the color filter 32, and an orientation film 34 is formed on the planarization film 33. The touch detection electrodes TDL are arranged side by side in a manner extending in one direction on the other surface of the glass substrate 31. The touch detection electrodes TDL are electrodes of a touch sensor that output a signal (touch detection signal) generated depending on a change in the capacitance caused by a contact from the outside or proximity scanning on a display surface 101Aa. The touch detection electrodes TDL are translucent electrodes made of an ITO, for example. As illustrated in FIG. 11, the touch detection electrodes TDL are each provided with a terminal PAD and coupled to the FPC 5 via the terminal PAD.

The FPC 5 is a flexible printed circuit that transmits the touch detection signals from the touch detection electrodes TDL to the outside. The FPC 5 is arranged on one side of the counter substrate 3 and coupled to the touch detection electrodes TDL via the terminals PAD. The FPC 5 is coupled to the detecting unit 120, the touch detection circuit 320, or a fixed potential 330 via a switch 311, which will be described later. The FPC 5 is also coupled to the applying unit 110 via a switch 312 (refer to FIG. 13), which will be described later.

Although the shape of the touch detection electrodes TDL in FIG. 11 is identical to the shape of the electrodes 102 and 103 according to the first embodiment, it may be identical to the shape of the electrodes 102A, 103A, and 104 according to the second embodiment. FIG. 11 does not illustrate the wiring L on the side opposite to the FPC 5 with the touch detection electrodes TDL interposed therebetween.

The liquid crystal layer 6 serves as a display function layer and modulates light passing therethrough depending on the state of an electric field. The electric field is formed by a potential difference between the voltage of the common electrodes COML and the voltage of the pixel electrodes EPIX. The liquid crystal layer 6 is made of liquid crystals driven in a lateral electric field mode, such as in-plane switching (IPS).

The seal 4 seals the liquid crystal layer 6 between the pixel substrate 2 and the counter substrate 3. The material of the seal 4 is an epoxy resin, for example. The seal 4 is formed at an outer periphery 41 of the pixel substrate 2 and the counter substrate 3.

The backlight BL irradiates a display area provided with the liquid crystal layer 6 with light from the pixel substrate 2 side. The backlight BL includes a plurality of light emitting diodes (LEDs) and a light guide plate, for example. Light emitted from the LEDs is guided by the light guide plate and thus output from a plane area.

Figure 13:
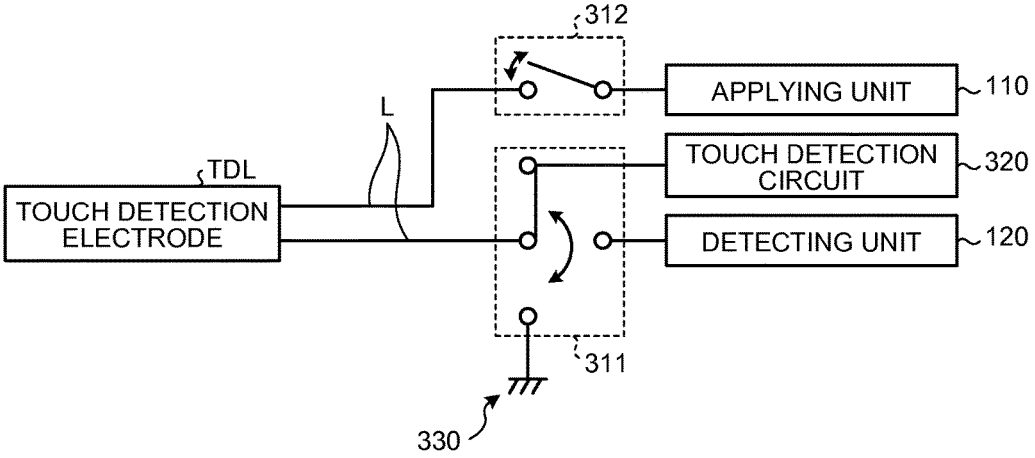
FIG. 13 is a diagram of an exemplary configuration of electrical coupling to a touch detection electrode.

FIG. 13 is a diagram of an exemplary configuration of electrical coupling to a touch detection electrode TDL. While FIG. 13 illustrates electrical coupling of one touch detection electrode TDL alone, the electrical coupling is applicable to all the touch detection electrodes TDL used for the processing relating to temperature. The switch 311 selectively couples any one of the detecting unit 120, the touch detection circuit 320, and the fixed potential 330 to the touch detection electrode TDL coupled to the switch 311 via the FPC 5 and the terminal PAD. The switch 312 selectively couples or does not couple the applying unit 110 to the touch detection electrode TDL coupled to the switch 312 via the FPC 5 and the terminal PAD. The switch 312, for example, couples the applying unit 110 to the touch detection electrode TDL only when the switch 311 couples the detecting unit 120 to the touch detection electrode TDL; otherwise, the switch 312 does not couple the applying unit 110 to the touch detection electrode TDL. The switches 311 and 312 are coupled to the touch detection electrode TDL as a configuration included in the wiring L. To perform touch detection by the touch detection circuit 320, the switch 311 couples the touch detection circuit 320 to the touch detection electrode TDL; whereas, to perform processing relating to the temperature of the touch detection electrode TDL, the switches 311 and 312 couple the applying unit 110 and the detecting unit 120 to the touch detection electrode TDL. The switch 311 couples the fixed potential 330 to the touch detection electrode TDL, thereby resetting an electrical change in the touch detection electrode TDL caused by the touch detection and the processing relating to the temperature. Thus, the touch detection electrode TDL serves as a shield electrode that shields an effect of static electricity in the display surface 101Aa on the display device.

The drive electrodes (e.g., the common electrodes COML), the touch detection electrodes TDL, and the touch detection circuit 320 in the display unit 101A with a touch detection function serve as an input device. By adding the following to the above components serving as the input device, these units serve as an input device according to the present invention: the coupling of the applying unit 110 and the detecting unit 120 illustrated in FIG. 13 and other figures, and the function of the executing unit 136 (e.g., the control unit 130) described in the embodiments.

The display unit 101A with a touch detection function is given as an example of a configuration including the touch detection electrodes also serving as shield electrodes. The touch detection electrodes and the shield electrodes also used as the electrodes according to the present invention are not limited thereto, and the specific aspect of the electrodes may be appropriately changed. Even in a case where electrodes arranged like the touch detection electrodes TDL do not have a touch detection function and is used as shield electrodes, for example, the shield electrodes may also be used as the electrodes for acquiring temperature information.

Figure 14:
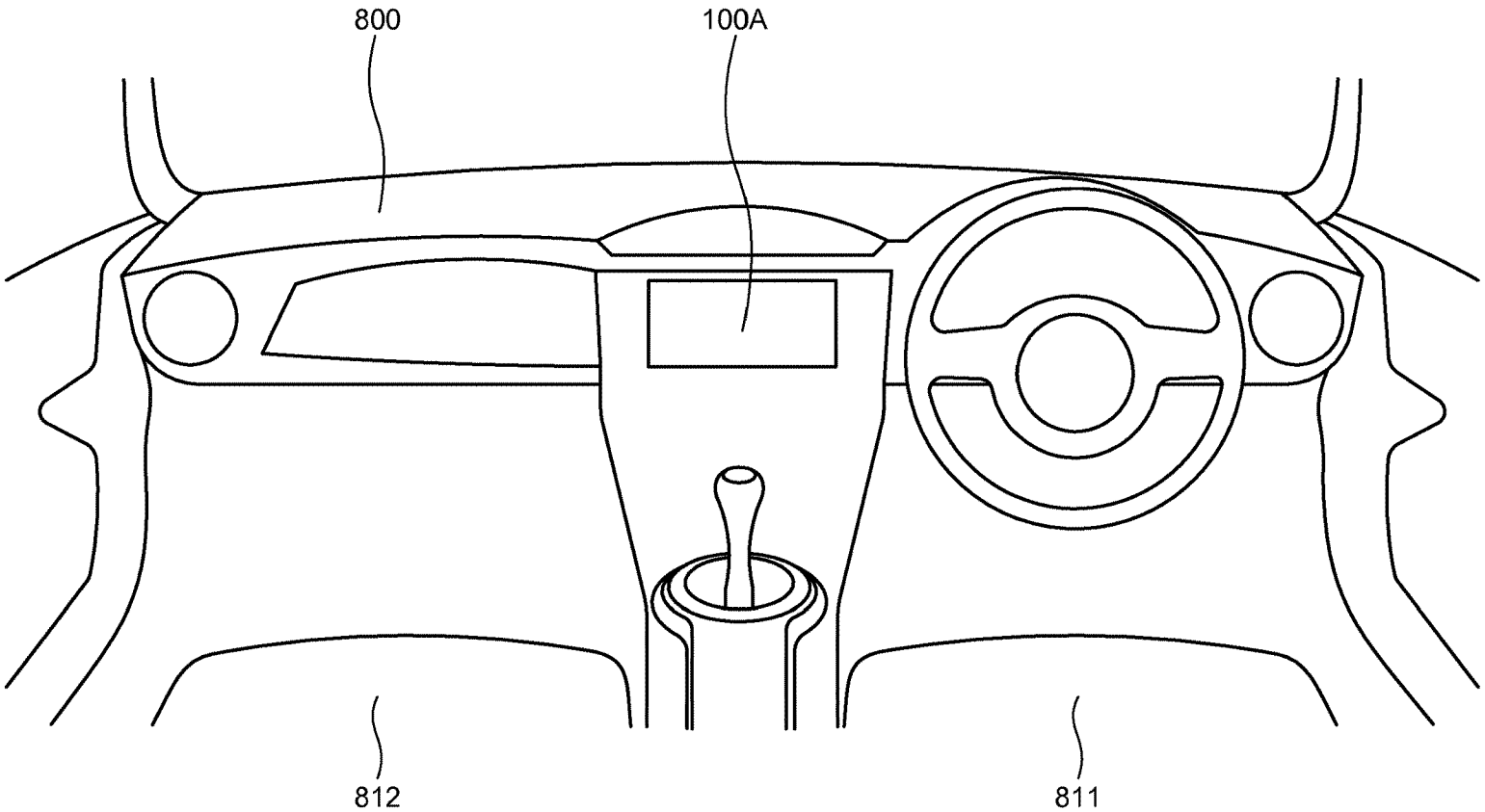
FIG. 14 is a diagram illustrating an example of an appearance of an in-vehicle display device to which the display device according to the present invention is applied.

FIG. 14 is a diagram illustrating an example of an appearance of an in-vehicle display device to which the display device according to the present invention is applied. The in-vehicle display device illustrated in FIG. 14 is a vehicle navigation apparatus to which the display device 100A with a touch detection function according to the present embodiment is applied. The display device 100A with a touch detection function is provided to a dashboard 800 in a vehicle. Specifically, the display device 100A with a touch detection function is arranged between a driver's seat 811 and a passenger seat 812 on the dashboard 800, for example. The display device 100A with a touch detection function of the vehicle navigation apparatus is used to display navigation information, an operating screen for music, or a reproduced movie, for example.

Third Application Example

Figure 15:
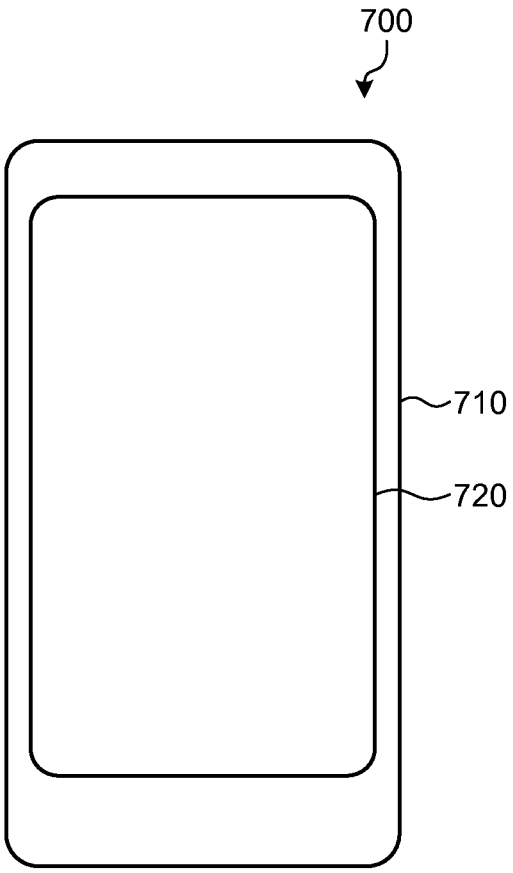
FIG. 15 is a diagram illustrating an example of an appearance of a smartphone to which the display device according to the present invention is applied.

FIG. 15 is a diagram illustrating an example of an appearance of a smartphone 700 to which the display device according to the present invention is applied. The smartphone 700 includes a display device 720 provided to one surface of a housing 710 of the smartphone 700, for example. The display device 720 is the display device 100A with a touch detection function, for example.

Others

The embodiments above have described a liquid crystal display device as an example of the disclosure. Other application examples include, but are not limited to, various flat-panel display devices, such as organic EL display devices, other light-emitting display devices, and electronic paper display devices including electrophoretic elements. The present invention is obviously applicable to any medium- or small-sized device and any large-sized device with no particular limitation.

The detecting unit 120 is not necessarily configured to detect the electric resistance. There is a correlation between the value of a voltage or a current corresponding to the electric resistance of the electrodes 102 and 103 and the like and the temperature distribution of the display surface 101*a* or 101Aa. The correlation is similar to that between the electric resistance and the temperature distribution of the display surface 101*a* or 101Aa. By using data indicating the correspondence relation between the value of the voltage or the current corresponding to the electric resistance and the temperature distribution of the display surface 101*a* or 101Aa, it is possible to specify the temperature distribution of the display surface 101*a* or 101Aa based on the value of the current or the voltage. In this case, the detecting unit 120 detects a parameter (the voltage or the current) included in the correspondence relation in the data from the electrodes 102 and 103 and the like.

The material of the electrodes provided as a component of the present invention is not limited to an ITO. The electrodes may be metal electrodes made of copper (Cu), for example. The electrical characteristics, such as the electric resistance, of the electrodes vary depending on the material of the electrodes. In a case where a lower-resistance material is used for the electrodes, the time constant of the circuit including the electrodes decreases. This structure reduces the time required to detect the electric resistance (the current or the voltage) generated by the electrical signal applied by the applying unit 110. Thus, the temporal resolution of the detecting unit 120 is preferably determined based on the material of the electrodes.

The number and the shape of the electrodes illustrated in FIG. 2 and other figures are given by way of schematic example only and are not limited thereto. The resolution in the temperature distribution using the electrodes, for example, optionally varies depending on the width of the electrodes and the gap between the electrodes within a range permitted by these design items. The electrodes may be tapered by changing the thickness or the diameter in the second direction. The degree of taper in the tapered structure is not necessarily indicated in a linear form and may be indicated by an exponential curve, for example. The reference electrodes are not necessarily arranged intermittently and may be arranged at every gap between the first electrodes and the second electrodes. The reference electrodes may be inclined or curved in the Y-direction depending on the angle of the taper of the first electrodes and the second electrodes, for example. The reference electrodes being inclined or curved in this manner facilitate increase in the density of the electrodes arranged side by side in the first direction.

The commands according to the embodiments above are given by way of example only and are not limited thereto. A cooling unit, for example, may be provided, and the executing unit 136 may output a command to cool the display unit 101 by operating the cooling unit when the temperature of the display surface 101*a* or 101Aa rises to a predetermined temperature (cooling-requiring temperature) or higher. When a portion having a temperature equal to or higher than a predetermined temperature (e.g., a display termination temperature) occurs, the display contents in the display area corresponding to the portion may be replaced by predetermined contents (e.g., monochromatic display). Subsequently, by retaining the display contents in the portion with the predetermined contents, it is possible to suppress disturbance in the display contents that may be caused by the switchover of the display contents at a high temperature. In addition, normal display in the other portion enables the display device to be continuously operated. Instead of executing the command to terminate the display performed by the display unit 101, the luminance of the backlight (e.g., the backlight BL) of the display unit 101 may be gradually decreased (or turned OFF) depending on an increase in the temperature. Alternatively, the cooling performed by the cooling unit and the luminance control on the backlight may be gradually changed depending on an increase in the temperature. The backlight may be individually controlled in units corresponding to the particular resolution (fractionalization of the range) in the temperature distribution with the electrodes. In this case, the executing unit 136 may output a command to control the backlight at the portion where the temperature rises alone. The cooling unit may include a configuration that locally cools the portion where the temperature rises (e.g., a wind collector and a wind direction changing unit). A warning unit that issues a voice warning, for example, may be provided to issue a voice warning when a portion having a temperature equal to or higher than the predetermined temperature occurs.

The control unit 130 serving as the specifying unit 135 and other units according to the embodiments above performs what is called software processing in which the arithmetic unit 132 reads out and executes a computer program from the storage unit 131. This is given by way of an example of a configuration of the control unit 130, and the configuration is not limited thereto. The control unit 130 may be hardware, such as an integrated circuit like an application specific integrated circuit (ASIC). A part or all of the specifying unit 135, the executing unit 136, and the determining unit 137 may be separately provided.

Among other advantageous effects achieved by the aspects according to the embodiments, effects apparent from the description of the present specification or effects appropriately conceivable by those skilled in the art are assumed to be naturally achieved by the present invention.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

a display unit that displays an image;

a plurality of electrodes arranged side by side in a first direction along a display surface of the display unit, the electrodes being a plurality of touch detection electrodes to perform touch detection;

a touch detection circuit that detects a touch operation based on capacitance changes of the electrodes;

a detecting unit that detects, to perform temperature distribution detection, one of an electric resistance of the electrodes, a voltage, and a current, the voltage and the current corresponding to the electric resistance;

an applying unit that applies an electrical signal for touch detection to the electrodes;

a plurality of switches each including a first switch and a second switch; and a specifying unit that specifies temperature distribution of the display surface based on the one of the electric resistance of the electrodes, the voltage, and the current, wherein the electrodes include:

a first electrode tapered toward one side in a second direction that is orthogonal to the first direction and that is along the display surface; and a second electrode tapered toward the other side opposite to the one side in the second direction, the first and second electrodes being alternately arranged side by side in the first direction, wherein the switches couple the electrodes to the touch detection circuit when the touch detection is performed, and wherein the switches couple to the electrodes to the applying unit and the detecting unit when the temperature distribution detection is performed.

2. The display device according to claim 1, further comprising an executing unit that executes a predetermined command when there is a portion in the display surface having a temperature equal to or higher than a predetermined temperature.

3. The display device according to claim 2, further comprising:

a determining unit that determines whether the portion in the display surface having a temperature equal to or higher than the predetermined temperature is in a designated area serving as a partial area in the display surface, wherein the executing unit executes a command to terminate display of the image performed by the display unit when the portion in the display surface having a temperature equal to or higher than the predetermined temperature is in the designated area.

4. The display device according to claim 1, wherein the electrodes are transparent electrodes provided in the display unit.

5. A display device comprising:

a display unit that displays an image;

a plurality of electrodes arranged side by side in a first direction along a display surface of the display unit;

a detecting unit that detects temperature information including one of an electric resistance of the electrodes, a voltage, and a current, the voltage and the current corresponding to the electric resistance; and a specifying unit that specifies temperature distribution of the display surface based on the temperature information, wherein the electrodes include:

a first electrode tapered toward one side in a second direction that orthogonal to the first direction and that is along the display surface;

a second electrode tapered toward the other side opposite to the one side in the second direction, the first and second electrodes being alternately arranged side by side in the first direction; and a reference electrode having a uniform shape in the second direction, wherein the specifying unit that specifies:

the temperature distribution in the second direction based on the temperature information of the electrodes including the first electrodes tapered toward one side in the second direction and the second electrode tapered toward the other side in the second direction, and the temperature distribution in the first direction based on the temperature information of the electrodes including the reference electrodes having a uniform shape in the second direction, the reference electrodes being arranged at a predetermined intervals to specify the temperature distribution in the first direction.

* * * * *